US005493182A

United States Patent [19]

Sowa et al.

[11] Patent Number: 5,493,182

[45] Date of Patent: Feb. 20, 1996

[54] FLUORESCENT LAMP OPERATING CIRCUIT, PERMITTING DIMMING OF THE LAMP

[75] Inventors: Wolfram Sowa, Munich; Christoph Kreutner, Herrsching, both of Germany

[73] Assignee: Patent-Treuhand-Gesellschaft F. Elektrische Gluehlampen MBH, Munich, Germany

[21] Appl. No.: 373,396

[22] Filed: Jan. 17, 1995

[30] Foreign Application Priority Data

Feb. 24, 1994 [DE] Germany ..... 44 06 083.1

[51] Int. Cl.[6] ..... G05F 1/00

[52] U.S. Cl. ..... 315/291; 315/307; 315/308; 315/311; 315/314; 315/DIG. 4

[58] Field of Search ..... 315/209 R, 224, 315/247, 291, 307, 308, 314, 282, 283, 311, DIG. 2, DIG. 4, DIG. 7

[56] References Cited

U.S. PATENT DOCUMENTS

| | | | |
|---|---|---|---|
| 4,808,887 | 2/1989 | Fahnrich et al. | 315/247 |
| 5,041,763 | 8/1991 | Sullivan et al. | 315/DIG. 4 X |
| 5,122,712 | 6/1992 | Hirschmann | 315/106 |
| 5,187,414 | 2/1993 | Fellows et al. | 315/307 |
| 5,262,701 | 11/1993 | Derra et al. | 315/224 |
| 5,394,064 | 2/1995 | Ranganath et al. | 315/209 R |

FOREIGN PATENT DOCUMENTS

| | | |
|---|---|---|
| 0059064B1 | 9/1982 | European Pat. Off. . |
| 541909A1 | 5/1993 | European Pat. Off. . |
| 3338464C2 | 5/1985 | Germany . |
| 9100552.3 | 5/1991 | Germany . |
| 8915386.3 | 6/1991 | Germany . |
| 2212995 | 8/1989 | United Kingdom . |
| WO93/07732 | 4/1993 | WIPO . |

OTHER PUBLICATIONS

IBM Technical Disclosure Bulletin, vol. 35, No. 7, Dec. 1992, pp. 28–29, "Combined Dimmer and Voltage Regulator Circuit For Fluorescent Lamp Inverter".

"Getaktete Stromversorgung"(Switched Power Supplies), by J. Beckman, published by Franzis–Verlag GmbH, p. 17–19 (1990).

"Schaltnetzteile")Switched Circuitry) by W. Hirschmann and A. Hauenstein, published by Siemens AG, Edition 1990 , p. 63.

*Primary Examiner*—Robert J. Pascal
*Assistant Examiner*—Haissa Philogene
*Attorney, Agent, or Firm*—Frishauf, Holtz, Goodman, Langer & Chick

[57] ABSTRACT

To provide for dimmer operation of a fluorescent lamp (L) with a minimum of circuit components, the d.c. output level at an output terminal (C1) of an energy supply source, such as a switched mode power supply (10, 10'), is controlled in accordance with the setting of a dimmer control (D). The voltage level at the output capacitor (C1) of the switched mode d.c. power supply furnishes supply voltage for an inverter (T1, T2) coupled to the discharge lamp. During lamp operation, a control unit (R) controls the level of the d.c. voltage supply for the inverter in accordance with the dimmer setting. This permits change of the brightness of the fluorescent lamp (L) in a range of from 5% to 100% of nominal value. Preferably, control of the supply voltage for the inverter is activated only upon occurrence of the ignition or arc-over phase, for example under control of a timing circuit (ZS), controlling a relay in the preheating circuit of the lamp. The system has the advantage that the lamp does not fire or ignite at full power level but only at the power level controlled by the dimmer (D).

10 Claims, 3 Drawing Sheets

FLUORESCENT LAMP OPERATING CIRCUIT, PERMITTING DIMMING OF THE LAMP

Reference to related patent, assigned to the assignee of the present invention, the disclosure of which is hereby incorporated by reference:

U.S. Pat. No. 4,808,887, Fahnrich and Zuchtriegel.

Reference to related publications:

European Patent Specification 0 059 064 B1, Webster

German 33 38 464 C2 (assigned Plankenhorn Kapitalverwaltungs-KG)

German Utility Model G 89 15 386 (assigned Zumtobel AG)

German Utility Model G 91 00 552 (assigned Trilux-Lenze)

European Published Application 0 541 909 A1, Zuchtriegel et al, assigned to the assignee of the present applicatoin.

Reference to related literature material:

(1) "Getaktete Stromversorgung" ("Switched Power Supplies"), by J. Beckmann, published 1990 by Franzis-Verlag GmbH, pages 17–19.

(2) "Schaltnetzteile" ("Switched Circuitry") by W. Hirschmann and A. Hauenstein, published by Siemens AG, Edition 1990, page 63.

FIELD OF THE INVENTION

The present invention relates to a circuit to operate at least one low-pressure discharge lamp at a frequency which is high with respect to standard network frequency of 50 or 60 Hz, and which permits dimming of the lamp, while providing full voltage for firing of the lamp already under dimmed condition. Typically, the low-pressure discharge lamp is a fluorescent lamp.

BACKGROUND

European Patent Specification 0 059 064 B1, Webster, describes a circuit arrangement permitting dimming of a fluorescent lamp. The circuit includes an externally controlled inverter which supplies a low-pressure discharge lamp, typically a fluorescent lamp, over a series resonant circuit. The electrode filaments of the lamp are preheated. During the electrode preheating phase, that is, before ignition of the discharge lamp, the inverter supplies the lamp with current having a frequency which is substantially above the resonant frequency of the series resonant circuit. The switching frequency of the inverter is changed in the direction of the resonant frequency of the series resonant circuit in order to fire the lamp. The required ignition voltage is obtained by the resonant peak occurring in the now effectively tuned resonant circuit. The lamp is operated at a frequency which is somewhat above the resonant frequency of the series resonant circuit, which is now adapted to the lamp.

The lamp can be dimmed or, in other words, the brightness of the lamp can be controlled, by changing the switching frequency of the inverter, and hence the frequency of the lamp current in dependence on the setting of a dimmer. Dimming is obtained by increasing this frequency. The resonance capacity is connected in parallel to the fluorescent lamp. Upon increase of the frequency, the impedance of the capacity decreases, which reduces the lamp current. Thus, dimming of the fluorescent lamp is obtained by changing the frequency of the inverter.

German Patent 33 38 464 (assigned Plankenhorn Kapitalverwaltungs-KG) describes a circuit with a freely oscillating inverter which operates a dimmable fluorescent lamp.

Control of the brightness of the fluorescent lamp is obtained by changing the duty cycle of the high-frequency alternating current energy derived from the inverter, in dependence on a setting of the dimmer control.

German Utility Model G 89 15 386 (assigned Zumtobel AG) describes a circuit arrangement permitting dimming of a fluorescent lamp. The dimming of the lamp is obtained by controlling a combination of frequency and duty cycle of alternating current supply delivered to the fluorescent lamp.

All the circuits so far described require comparatively complex circuitry, and have the disadvantage that the fluorescent lamp, immediately after ignition, operates initially at full power, independently of the setting of the dimmer, and before the dimmer control unit can control the frequency and/or the duty cycle of the inverter supplying the lamp in accordance with the setting of the dimmer control.

German Utility Model G 91 00 552 (assigned Trilux-Lenze) describes a different arrangement; the circuit has a half-wave inverter which supplies a fluorescent lamp over a series resonant circuit. Dimming or brightness control of the lamp is effected generally similar to a phase control of a load. A bridging or shunt switch is connected in parallel to the lamp and bridges or shunts the fluorescent lamp in accordance with a controllable phase angle of the lamp current. The control of the phase angle depends on the setting of the dimmer. The current flowing across the discharge path of the fluorescent lamp is thus weakened in accordance with the setting of the dimmer control. Matching the bridging circuit and switching element included in the shunt circuit to the switching phases of the inverter is complex and requires substantial circuitry.

THE INVENTION

It is an object to provide a simple and improved circuit arrangement permitting dimmer operation of at least one low-pressure discharge lamp, typically a fluorescent lamp.

Briefly, a direct current energy supply is provided, for example by connecting a switched mode power supply and rectifier to a network power supply. A regulator unit controls the output voltage of the d.c. energy supply; the d.c. energy supply is connected to a d.c./a.c. inverter which, in turn, is coupled to the lamp or lamps, and supplies the lamp or lamps with electrical energy. Thus, the voltage of the output energy supplied to the inverter is controlled to a value which depends on the setting of the dimmer. The circuit in accordance with the invention essentially includes an inverter with an L/C output circuit connected thereto, to supply the low-pressure discharge lamp or lamps with voltage. The d.c. supply is formed by a converter or switched power supply having a rectifier at its output. The dimmer and the regulator unit are preferably connected to this power supply such that the control unit controls the setting of the operating voltage for the inverter after firing of the lamp to a value which depends on the selected degree of dimming as set by the dimmer.

The controlled, for example decreased supply voltage for the inverter, set in accordance with the dimmer, will result in a reduced lamp current although the working frequency of the inverter will be effectively constant or at least substantially constant. The reduced lamp current, thus, causes operation of the fluorescent lamp at a decreased power level immediately after it has fired.

The circuit is particularly suitable to operate one or more fluorescent lamps with dimming capability. The fluorescent lamp is supplied from a half-wave inverter connected to a series resonant circuit, integrated with the lamp circuit. The d.c. supply voltage of the half-wave inverter is, preferably, constructed in form of a converter or a blocking oscillator connected to a rectifier diode and a capacitor to provide a d.c. output voltage which, in turn, is connected to the input of the inverter supplying the current to the lamp itself. A switching transistor of the converter or the blocking oscillator is controlled from the control unit which supplies a control signal which depends on the setting of the dimmer, so that an output capacitor from the converter or blocking oscillator will have a value which depends on the setting of the dimmer. Thus, the output voltage of the d.c. supply unit is set in accordance with the control value provided by the dimmer during operation of the lamp, via the control unit. Preferably, the electrode filaments of the lamp or lamps are preheated, as is customary, in order to ensure gentle and smooth starting. The duration of preheating of the lamps, as well as the value of the heating voltage, must be independent of the previously set brightness of a lamp, when it has fired. Accordingly, the control unit is so constructed that the control signal from the dimmer does not influence the control unit during the preheating phase of the lamp electrodes.

In accordance with a feature of the invention, the transition from the electrode preheating phase to dimmed illuminated operation is obtained by a timing switch or timing element which triggers a relay at the end of the preheating phase. This relay briefly bridges the electrode filaments so that the lamp may fire. The timing switch, simultaneously, ensures that the light value or brightness set by the dimmer will immediately control the control unit. This ensures that the lamp will operate at the predetermined setting of the dimmer immediately after starting. The voltage drop across the discharge path is decreased during the preheating phase, and increased during the ignition phase. This is obtained, in accordance with a particularly preferred feature of the invention, by constructing the capacitance connected parallel to the discharge path by two parallel connected capacitors. During the preheating phase, and also upon operation of the lamp, that is, after the lamp has fired or ignited, both resonance capacitors are connected in the series resonant circuit. During the ignition phase, however, one of the two capacitors is disconnected from the series resonant circuit by the relay.

DRAWINGS

Figure 4:
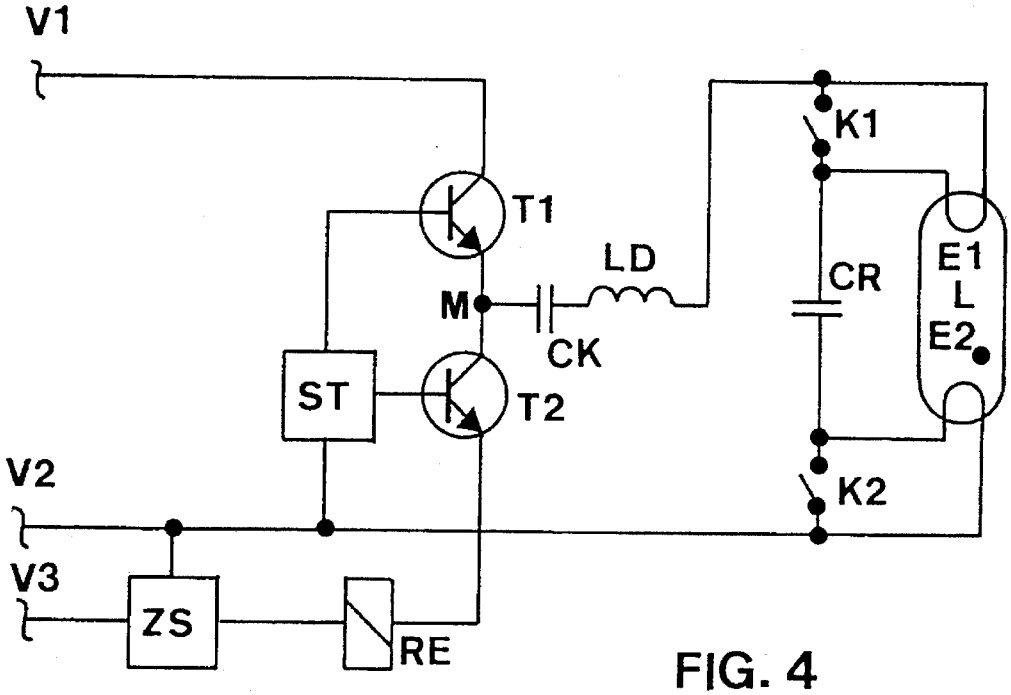
FIG. 4 is a fragmentary circuit diagram, illustrating the lamp inverter and a series resonant circuit connected to the lamp.
Figure 5:
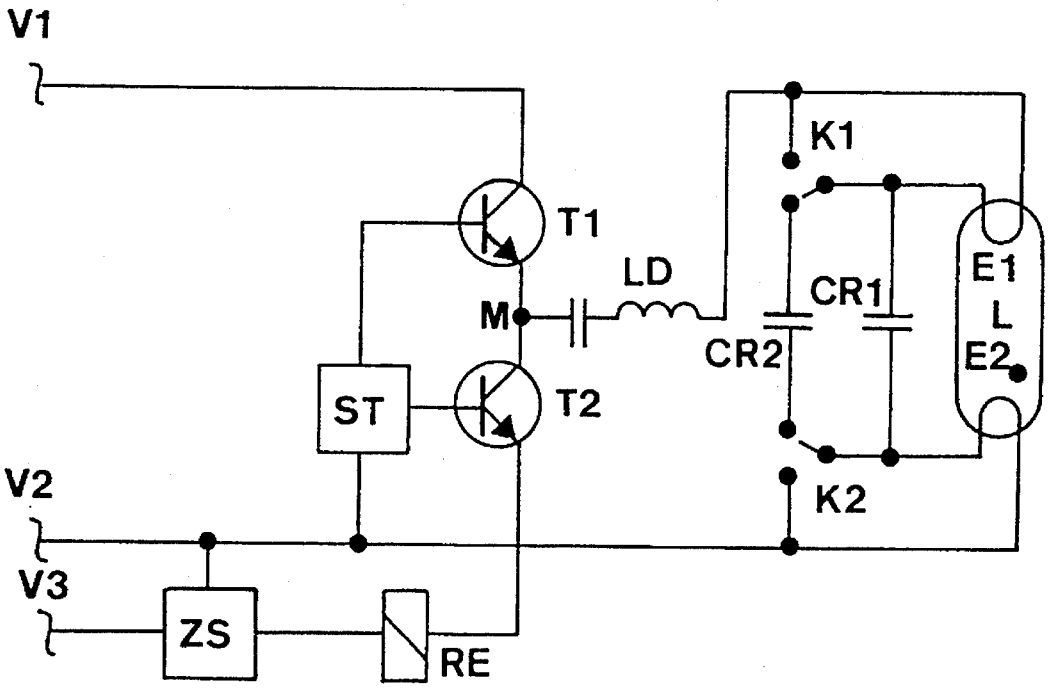
FIG. 5 is a fragmentary diagram of the inverter and a series resonant circuit connected to the lamp, in accordance with another embodiment.
Figure 6:
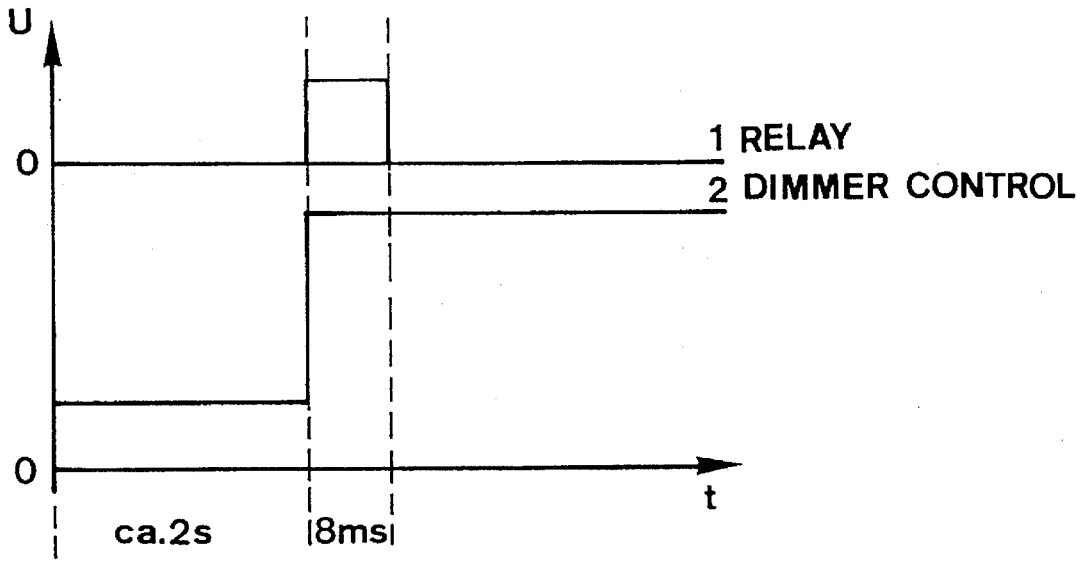
Figure 7:
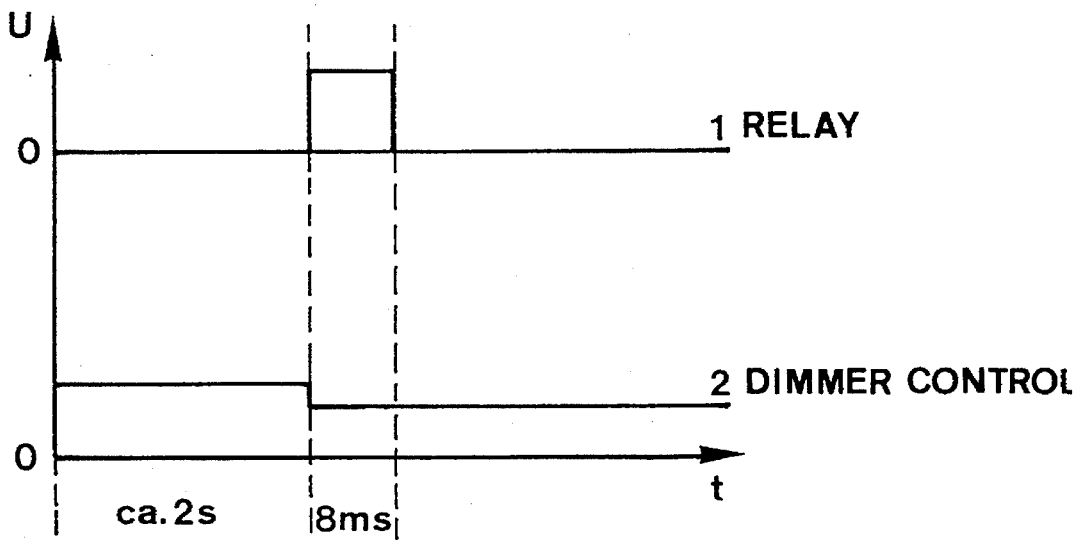

FIG. 6 is a schematic diagram of voltage U, with respect to time, illustrating control signals for the relay shown in FIGS. 4 and 5, respectively (curve 1) and of inverter supply voltage control (curve 2) during the transition from electrode preheating and dimmed operation at maximum dimmer setting; and FIG. 7 is a schematic diagram of voltage U, with respect to time, illustrating control signals for the relays shown in FIGS. 4 and 5 (curve 1) and of inverter supply voltage control (curve 2) during the transition from electrode preheating and dimmed operation at lowest dimmer setting.

DETAILED DESCRIPTION

Figure 1:
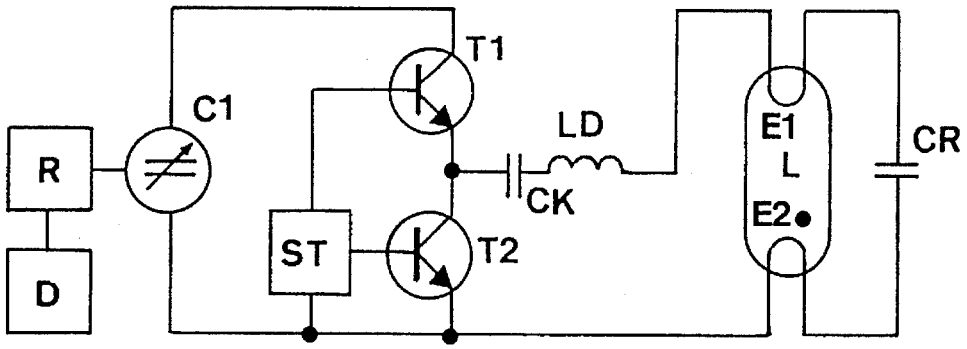
FIG. 1 is a highly schematic diagram of the basic principle of operation of the circuit in accordance with the present invention.

Referring first to the highly schematic simplified circuit of FIG. 1, which illustrates the basic principle in accordance with the present invention.

A freely oscillating half-bridge inverter includes transistors T1 and T2 which, in turn, are coupled to a series resonant circuit, providing energy supply to a fluorescent lamp L. The series resonant circuit includes a coupling capacitor CK, a series resonance inductance LD and a resonance capacity CR, as well as the electrode filaments E1, E2 of the lamp L. All these circuit elements are connected in series. The resonance capacity, formed by capacitor CR, is so connected between the two electrode filaments El, E2 that the capacitor will be parallel to the discharge path of the lamp L. The half-bridge inverter T1, T2 receives its current supply from the output capacitor C1 of a d.c. supply unit, preferably a controllable switched mode power supply, not shown in FIG. 1. The d.c. supply unit will be described below, in connection with FIGS. 2 and 3. The half-bridge inverter transistors T1, T2 are controlled from a control unit ST. The operating frequency of such a half-bridge inverter is approximately in the vicinity of the resonance frequency of the elements CR, LR in the output circuit thereof. A dimmer control D is connected to a dimmer control unit R which, in turn, controls the d.c. output voltage at the capacitor C1 supplying operating energy to the lamp or lamps.

The brightness of the lamp L is determined by the supply voltage, as controlled by the control unit R, and available at the output capacitor C1. The control unit R, in turn, is controlled in dependence on the setting of a dimmer unit D.

Basic Operation

Decreasing the supply voltage for the half-bridge inverter T1, T2 reduces the current through the lamp L which, then, will operate at reduced power. This somewhat unloads the series resonant circuit, formed by the resonance capacitor CR and the resonance inductance LR, so that the quality of the oscillating circuit, and hence the voltage on the resonance capacitor CR increases. At the same time, current through the capacitor CR increases and, consequently, the current through the electrode filaments E1, E2 of the lamp L.

Figure 2:
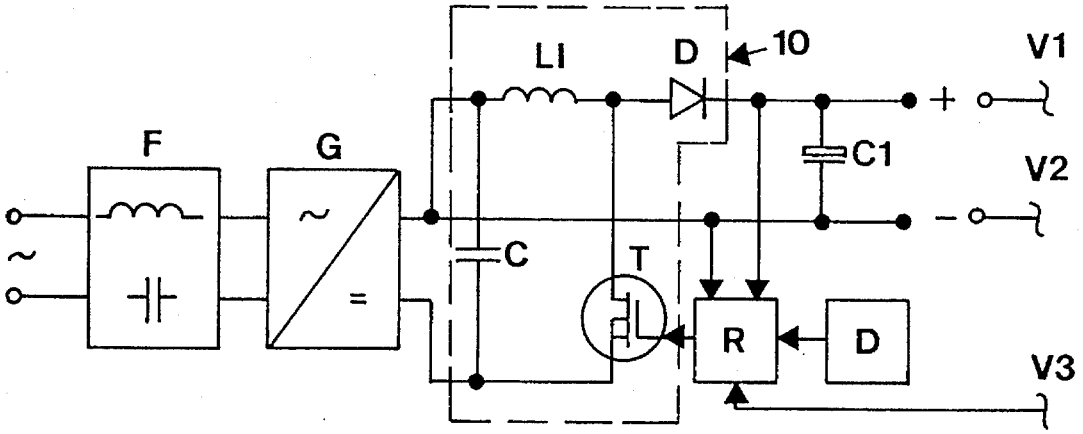
FIG. 2 is a fragmentary block diagram illustrating the d.c. supply unit for the lamp inverter, constructed as a negative impedance oscillator.

FIG. 2 illustrates a first example of the d.c. energy supply for the half-wave bridge inverter T1, T2. The power supply for the lamp is, basically, a controllable switched mode power supply, and, in accordance with FIG. 2, is a converter 10. A rectifier G is connected to network supply terminals through a high-frequency filter F which prevents feedback of high-frequency interference or noise signals into the supply network. Such filters are well known and can be constructed in any suitable manner.

A suitable filter is illustrated in U.S. Pat. No. 4,808,887, Fahnrich and Zuchtriegel, assigned to the assignee of the present application, the disclosure of which is hereby incorporated by reference. This circuit can be improved, as described in the European Published Application 0 541 909 A1, Zuchtriegel et al, by connecting a feedback circuit including a coupling element between one of the filament connections and a suitable terminal or tap in the high-frequency filter shown in the referenced patent. The coupling circuit is so dimensioned, as can be determined experimentally, that a high-frequency signal derived from the filament circuit of the lamp is fed back to the network voltage with the same frequency and approximately the same amplitude, but 180° out of phase with high-frequency interference signals, to thereby substantially lower the level of interference and disturbance signals fed back into the power network.

A rectifier output capacitor C is connected across the output from the rectifier G, to smoothen the rectified output derived from network power. The converter includes a field effect transistor (FET) T, an inductance LI, a diode D and an electrolytic capacitor C1, which corresponds to the capacitor C1 of FIG. 1. The electrolytic capacitor C1 is connected in parallel to the output of the converter. The structural components of the converter are so connected that the output voltage of the converter is superimposed on the rectified instantaneous network voltage.

In accordance with a feature of the invention, the control unit R is connected in parallel to the output capacitor C1 of the converter. The connection across the capacitor C1 forms an input to the control unit R. The control unit R receives a further input from the output of the dimmer D. The output of the control unit R is connected to the gate terminal of the FET T. The operation of the converter 10 is well known, and a suitable literature reference is found, for example, in the book "Getaktete Stromversorgung" ("Switched Power Supplies"), by J. Beckmann, published by Franzis-Verlag GmbH, pages 17–19.

The output from the converter circuit 10, as well as an input to the regulator R, is shown at interface connections V1, V2, V3. The circuit 10 is connected to the further portions of one of the circuits illustrated in FIGS. 4 and 5 at the respective interface connections. To obtain a view of the entire circuit, it is necessary to connect the circuits of FIG. 2 or 3 with the circuits of FIG. 4 or 5, in any combination, at the respective interface connections.

For example, the half-bridge inverter transistors T1, T2 are supplied from the capacitor C1 via the interface connections V1, V2, furnishing supply voltage. The timing switch ZS (FIG. 4) is connected to a third control input of the control unit R.

The inverter is a freely oscillating half-bridge oscillator having transistors T1, T2, operating with current feedback. Circuitry for such a control circuit ST is well known in the art. A detailed description of the control circuit ST for such an oscillator, connected to the base of the switching transistors T1, T2 or, if the switching transistors T1, T2 are FEDs, to the gate electrodes thereof, is found in the book "Schaltnetzteile" ("Switched Circuitry") by W. Hirschmann and A. Hauenstein, published by Siemens AG, Edition 1990, page 63. The center connection or terminal M of the half-bridge oscillator T1, T2 is coupled to a series resonant circuit, formed by the coupling capacitor CK, the resonance inductance LD, a resonance capacitor CR, and the electrode filaments E1, E2 of the fluorescent lamp. All these elements are connected in series. The resonance capacitor CR is so integrated in the series resonant circuit that it is connected in parallel to the discharge path of the lamp L.

In addition to the foregoing, the circuit includes two relay controlled switching contacts K1, K2, each connected in parallel to the electrode filaments E1, E2, respectively. The relay contacts K1, K2 are controlled by a relay coil RE, which is serially connected to the timing circuit ZS.

Operation

Upon connection of the circuit of FIG. 2 to a power network, the converter 10 illustrated in FIG. 2 will build up the supply voltage for the half-bridge rectifier T1, T2 on the electrolytic capacitor C1. This supply voltage, initially, is independent of the setting of the dimmer control D. Its value is so selected that, during the preheating phase, the voltage at the center terminal M of the half-bridge circuit T1, T2 is sufficient to provide current necessary for preheating of the electrodes through the series resonant circuit. During this electrode preheating phase, which may extend for approximately two seconds, the relay contacts K1, K2 (FIG. 4) are in the open position shown. Thus, the electrode filaments E1, E2 are serially connected in the series resonant circuit; the high-frequency heating current flows through the filaments. The resistance of the electrode filaments E1, E2 dampens the series resonant circuit and prevents firing of the lamp L.

As the preheating phase terminates, the timing circuit or timing switch ZS triggers the relay RE, so that the two relay contacts K1, K2 close. This closing phase is short, for example 8 ms. At the same time, the control unit R is activated by the timing circuit. The short-time closing of the relay contacts K1, K2 bridges the electrode filaments E1, E2. Consequently, damping of the series resonant circuit is removed and the ignition or firing voltage will build up on the resonance capacity CR, so that the lamp L can fire or light.

During normal lamp operation, that is, after firing of the lamp L, the relay contacts K1, K2 open again. The control unit R, however, which was activated by the timing circuit ZS, detects the voltage at the output capacitor C1 of converter 10, which is supplied to the inverter T1, T2. This voltage is compared with a control signal derived from the dimmer D, and provides a control or command signal; the dimmer control unit R, due to its connection to the gate electrode of the FET T, controls the duty cycle of the transistor T and thus controls the output voltage of the converter 10 on the electrolytic capacitor C1.

Decrease of the output voltage from the converter 10 means a reduced supply voltage for the half-wave inverter T1, T2. The voltage at the center terminal M of the half-wave inverter T1, T2 is then correspondingly reduced, so that a decreased current will flow through the series resonant circuit and over the discharge path of the lamp L. This controls the power supply to the lamp and hence the brightness of the lamp by controlling the supply voltage to the inverter in dependence on the setting of the dimmer D.

FIGS. 6 and 7 illustrate, in highly schematic form, the course of the control signals for the relay RE (curve 1) and for the control unit R (curve 2) upon transition from the electrode preheating phase to normal lamp operation, including the firing phase, for two different dimmer settings.

During the preheating phase, which has a duration of about 2 seconds, the control signal for the control unit R, curve 2 in FIGS. 6 and 7, and hence the control voltage for the gate electrode for the transistor T, is independent of the setting of the dimmer D. The relay RE does not receive a control signal and the switching contacts K1, K2 are open. As the firing phase starts, the control unit R is activated and the gate electrode of the FET T receives different control signals, depending on the setting of the dimmer. The ignition phase has a duration of about 8 ms. At this time, the relay RE receives a control signal so that the two relay contacts K1, K2 close. After firing of the lamp L, both relay contacts open again, and the relay RE does not receive a control signal anymore. The control voltage for the gate electrode of the FET T is then determined by the setting of the dimmer D and by the control unit R.

Figure 3:
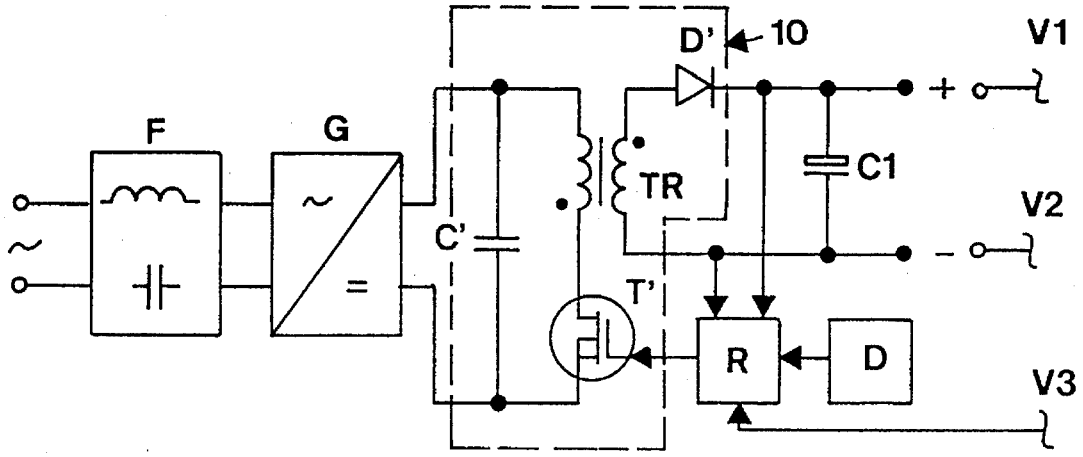
FIG. 3 is a fragmentary diagram of the d.c. supply unit for the inverter for lamp operation, constructed as a blocking oscillator.

FIG. 5 illustrates another embodiment of the circuit arrangement in accordance with the present invention. The inverter, again, is connected to the interface connections V1, V2, V3, to receive supply voltage from the converter 10 of FIG. 2 or 10' of FIG. 3. The difference between the circuits of FIG. 4 and 5 is in the resonance capacity of the resonant circuit. The resonance capacity, in accordance with FIG. 3, is a two-part circuit. It is formed of two parallel capacitors CR1 and CR2, both connected in parallel to the discharge path of the lamp L. During the preheating phase, and after the lamp has started, both resonance capacitors CR1,CR2 are connected in the series resonant circuit, as illustrated by the switching position of the relay contacts K1, K2 in FIG. 5. During the ignition phase, however, and under control of the timing circuit ZS, the relay RE causes the switching terminals of the relay contacts K1, K2 to change over so that the resonance capacitor CR2 is removed from the circuit. Only the capacity of the capacitor CR1 will still be effective. This arrangement permits decreasing the voltage drop across the discharge path of the lamp L during the preheating phase, while increasing it during the ignition phase. This arrangement effectively eliminates cold-starting of the lamp L and, additionally, ensures reliable starting of the lamp during the ignition phase.

The voltage supply can be constructed differently from the embodiment shown in FIG. 2; the blocking oscillator circuit 10' illustrated in FIG. 3 may also be used to supply voltage to the half-bridge inverter T1, T2. The blocking oscillator 10' is supplied, as in FIG. 2, from a network supply, for example 110 V, 60 Hz, 220 V, 50 Hz, through a high-frequency filter F and a rectifier G, to receive power at power line voltage, smoothed by the smoothing capacitor C'. The converter circuit 10' includes a field-effect transistor T', a transformer TR, and an electrolytic capacitor C1, connected in parallel to the secondary of the transformer TR and a serially connected diode D'. This circuit, and the operation of such a blocking oscillator, is well known, see for example the above referenced book "Getaktete Stromversorgung" ("Switched Power Supplies"), by J. Beckmann, published by Franzis-Verlag GmbH, pages 17–19. The control unit R and the dimmer D are the same as described in connection with FIG. 2. The control unit R has its output connected to the gate electrode of the FET T'; the inputs are connected across the output capacitor C1, and the control unit receives a command input from the dimmer D and a timing input from the timing circuit ZS, across interface connection V3. As before, the control unit R controls the duty cycle of the transistor T', and thus controls the supply voltage across the capacitor C1, which voltage supplies the half-bridge inverter T1, T2, in dependence on the selected position and setting of the dimmer D. Control of the inverter supply voltage, in accordance with the setting of the dimmer D, is activated only at the beginning of the ignition phase by the timing circuit ZS. The interface connections V1, V2 and V3 connect with any one of the circuits shown in FIG. 4 or 5, in accordance with the prior description.

The dimmer D, the timing circuit ZS and control unit R can be constructed in various ways. The dimmer D, for example, generates a voltage at the input to the control unit R which can vary between 1V (lowest dimming) and 10V (highest dimming). In the simplest way, a dimmer potentiometer can be used. The timing circuit ZS may be constructed, for example, as an RC element with a comparator connected thereto. The timing constant of the RC circuit generally determines the duration of the electrode preheating phase. The control unit R can be a PI or PID controller with a subtracting circuit connected in advance. The subtracting circuit, for example, receives as an input the dimmer signal and a voltage signal proportional to the supply voltage across capacitor C1, to generate a difference or control voltage which provides a signal to control the gate electrode of the transistor T' of the d.c. supply circuit.

The circuit permits controlling the power supply of the lamp L from full power output down to about 5% of its nominal rating.

Various changes and modifications may be made, and any features described herein may be used with any of the others, within the scope of the inventive concept.

The reason for the presence of the switched mode power supply is lamp operation at higher frequency than standard network frequency of 50 or 60 Hz, permitting use of an inductance LI which is less voluminous and has lower weight. In addition, the switched mode power supply provides lamp operation without flickering at essentially unity power factor.

We claim:

1. Operating circuit for at least one low-pressure discharge lamp (L) while permitting dimming of the at least one lamp, having a controlled voltage d.c. energy supply source (10, 10', C1) having a control input;

a d.c./a.c. inverter (T1, T2) coupled to the lamp or lamps (L) and supplying the lamp or lamps with electrical energy, said inverter being connected to the d.c. energy supply source and receiving electrical energy therefrom; and a user-settable dimmer (D) for controlling the brightness of the operation of the lamp or lamps (L), and comprising, a regulator unit (R) coupled to the dimmer (D) and controlled thereby in accordance with a selected setting of the dimmer, said regulator unit (R) having a first input coupled to the output of the dimmer (D), a second input connected in parallel to the d.c. energy supply source C1), and an output coupled to the control input of the d.c. energy supply source. and controlling the output voltage thereof, and hence the voltage of the input energy supplied to the inverter T1, T2) to a value dependent on the setting of the dimmer (D).

2. The circuit of claim 1, wherein the d.c. energy supply source (10, 10' C1) includes a pulsed converter circuit (10).

3. The circuit of claim 1, wherein the d.c. energy supply source (10, 10' C1) comprises a blocking oscillator (10').

4. The circuit of claim 1, wherein the d.c. energy supply source (10, 10', C1) includes an output capacitor (C1) connected across the output terminals thereof, said d.c./a.c. inverter (T1, T2) being connected across said output capacitor which supplies the d.c. energy supply for the inverter.

5. The circuit of claim 1, wherein the d.c. energy supply source comprises a voltage enhancement circuit (10, T, C, L, D; 10' T' TR C' D').

6. The circuit of claim 1, wherein the d.c./a.c. converter (T1, T2) comprises a free-running oscillator having two switching transistors and a series resonant circuit, including a coupling capacitor (CK), a resonance inductance (LD), and a resonance capacity (CR).

7. The circuit of claim 6, wherein the low-pressure discharge lamp has two filaments (E1, E2);

the filaments (E1, E2) of the discharge lamp being serially connected with the coupling capacitor (CK), the resonance inductance (LD) and the resonance capacity (CR) of the resonance circuit; and a switch contact (K1, K2) is connected in parallel with respect to at least one of the electrode filaments (E1, E2).

8. The circuit of claim 7, further including a timing circuit (ZS) connected to control both the switch contacts (K1, K2) and the regulator unit (R).

9. The circuit of claim 8, wherein the resonance capacity (CR) includes two parallel connected resonance capacitors (CR1, CR2).

10. The circuit of claim 1, wherein the d.c. supply source comprises a switched mode power supply (10, 10') including reactive impedances, a controlled semiconductor switching element (T, T') and an output rectifier (D, D'); and wherein said regulator unit is connected to and controls said semiconductor switching element of the switched mode power supply.

* * * * *